US006012429A

United States Patent [19]

Beatty et al.

[11] Patent Number: 6,012,429

[45] Date of Patent: Jan. 11, 2000

[54] HYDRAULICALLY-ACTUATED FUEL INJECTOR WITH IDLE STABILITY PORT

[76] Inventors: David J. Beatty, 2000 N. Linden, #304, Normal, Ill. 61761; Ralph A. Smith, III, 3208 Clearwater; Steven Y. Tian, 25 Swan Lake, both of Bloomington, Ill. 61704

[21] Appl. No.: 08/740,288

[22] Filed: Oct. 25, 1996

[51] Int. Cl.[7] ..... F02M 41/00

[52] U.S. Cl. ..... 123/446; 123/467; 123/506

[58] Field of Search ..... 123/446, 467, 123/506

[56] References Cited

U.S. PATENT DOCUMENTS

| | | | |
|---|---|---|---|
| 1,155,266 | 9/1915 | Pasel . | |
| 2,097,241 | 10/1937 | Richards et al. | 299/107.6 |
| 2,126,623 | 8/1938 | Dow | 299/107.4 |
| 3,351,288 | 11/1967 | Perr | 239/89 |
| 3,425,635 | 2/1969 | Guertler | 239/453 |
| 3,544,008 | 12/1970 | Reimers | 239/90 |
| 5,029,568 | 7/1991 | Perr | 123/506 |
| 5,292,072 | 3/1994 | Rix et al. | 239/533.3 |
| 5,423,484 | 6/1995 | Zuo | 239/90 |
| 5,492,098 | 2/1996 | Hafner et al. | 123/446 |
| 5,577,892 | 11/1996 | Schittler et al. | 123/506 |

*Primary Examiner*—Thomas N. Moulis

[57] ABSTRACT

A hydraulically-actuated fuel injector includes an injector body having a nozzle chamber that opens to a nozzle outlet and a plunger bore, and further has a prime spill port and an idle stability port that open to the plunger bore. A hydraulic means for pressurizing fuel in the nozzle chamber includes a plunger mounted to reciprocate in the plunger bore between a retracted position and an advanced position. A portion of the plunger bore and plunger define a fuel pressurization chamber. A needle valve member is mounted to reciprocate in the nozzle chamber between an open position in which the nozzle outlet is open and a closed position in which the nozzle outlet is closed. A portion of the plunger blocks the prime spill port when the plunger is in its retracted position. A different portion of the plunger blocks the idle stability port when the plunger is in its retracted position. The prime spill port opens to the fuel pressurization chamber over part of the plunger stroke between its retracted position and its advanced position. The idle stability port opens to the fuel pressurization chamber over a different part of the plunger stroke between its retracted position and its advanced position. The prime spill port has a relatively unrestricted flow area, whereas the idle stability port has a relatively restricted flow area about equal to that of the nozzle outlet.

20 Claims, 5 Drawing Sheets

HYDRAULICALLY-ACTUATED FUEL INJECTOR WITH IDLE STABILITY PORT

TECHNICAL FIELD

The present invention relates generally to hydraulically-actuated fuel injection systems, and more particularly, to the operation of such injection systems at idle or low fuel demand conditions.

BACKGROUND ART

Known hydraulically-actuated fuel injection systems and/or components are shown, for example, in U.S. Pat. No. 5,423,484 issued to Zuo on Jun. 13, 1995 and U.S. Pat. No. 5,492,098 issued to Hafner et al. on Feb. 20, 1996. In these hydraulically-actuated fuel injectors, a spring biased needle check opens to commence fuel injection when pressure is raised by an intensifier piston/plunger assembly to a valve opening pressure. The intensifier piston is acted upon by a relatively high pressure actuation fluid, such as engine lubricating oil, when a solenoid driven actuation fluid control valve opens the injector's high pressure inlet. Injection is ended by deactivating the solenoid to release pressure above the intensifier piston. This in turn causes a drop in fuel pressure causing the needle check to close under the action of its return spring to end injection.

Engineers have observed that engines using these fuel injectors can sometimes exhibit unsteady behavior when operating at idle conditions. This unsteady behavior reveals itself as an oscillating rpm at idle conditions, which corresponds to when the fuel injectors are commanded to inject their lowest quantity of fuel. It has been found that the quantity of fuel injected from the injector is very sensitive to fluctuations in the common rail supplying actuation fluid to the injectors as well as variations in the actuation control valve motion. Normal fluctuations in the common rail pressure can result in significant variations in the injected fuel quantity at idle conditions.

Since the injector's solenoid is energized for such a short amount of time at idle conditions, injection quantities can also vary due to the irregular poppet valve motion. In this second instance, small variations in the commanded on-time can itself cause variations in injected fuel quantity. Also, on-times that are insufficient to move the actuation poppet control valve to stop at its upper seat before being commanded to close can also result in variations in injected quantity. In other words, slight variations in the solenoid on-time can cause the poppet valve to bounce off its upper seat and close more quickly than it might for a slightly shorter on-time. Since unsteady engine performance is very undesirable, especially at idle conditions, there is a motivation to make these hydraulically-actuated fuel injectors less sensitive to fluctuations in rail pressure and/or poppet control valve motion variations.

The present invention is directed to overcoming one or more of the problems as set forth above.

DISCLOSURE OF THE INVENTION

In one embodiment of the present invention a hydraulically-actuated fuel injector includes an injector body having a nozzle chamber that opens to a nozzle outlet and a plunger bore, and further has an idle stability port that opens to the plunger bore. A hydraulic means for pressurizing fuel in the nozzle chamber includes a plunger mounted to reciprocate in the plunger bore between a retracted position and an advanced position. A portion of the plunger bore and the plunger define a fuel pressurization chamber. A needle valve member is mounted to reciprocate in the nozzle chamber between an open position in which the nozzle outlet is open and a closed position in which the nozzle outlet is closed. The plunger moves from its retracted position toward its advanced position a relatively short distance when the injector is operating at an idle condition. The idle stability port has a flow area sufficiently restrictive that pressure in the nozzle chamber is sustained above a valve closing pressure when the idle stability port is open and the injector is operating at its idle condition. Finally, a portion of the plunger blocks the idle stability port when the plunger is in its fully retracted position.

In another embodiment of the present invention, the hydraulically-actuated fuel injector includes a prime spill port as well as an idle stability port. The prime spill port causes the injector to inherently inject a split injection when operating at an idle condition. The idle stability port significantly lowers variation in the injection quantity for the second shot of fuel at idle conditions.

BEST MODE FOR CARRYING OUT THE INVENTION

Figure 1:
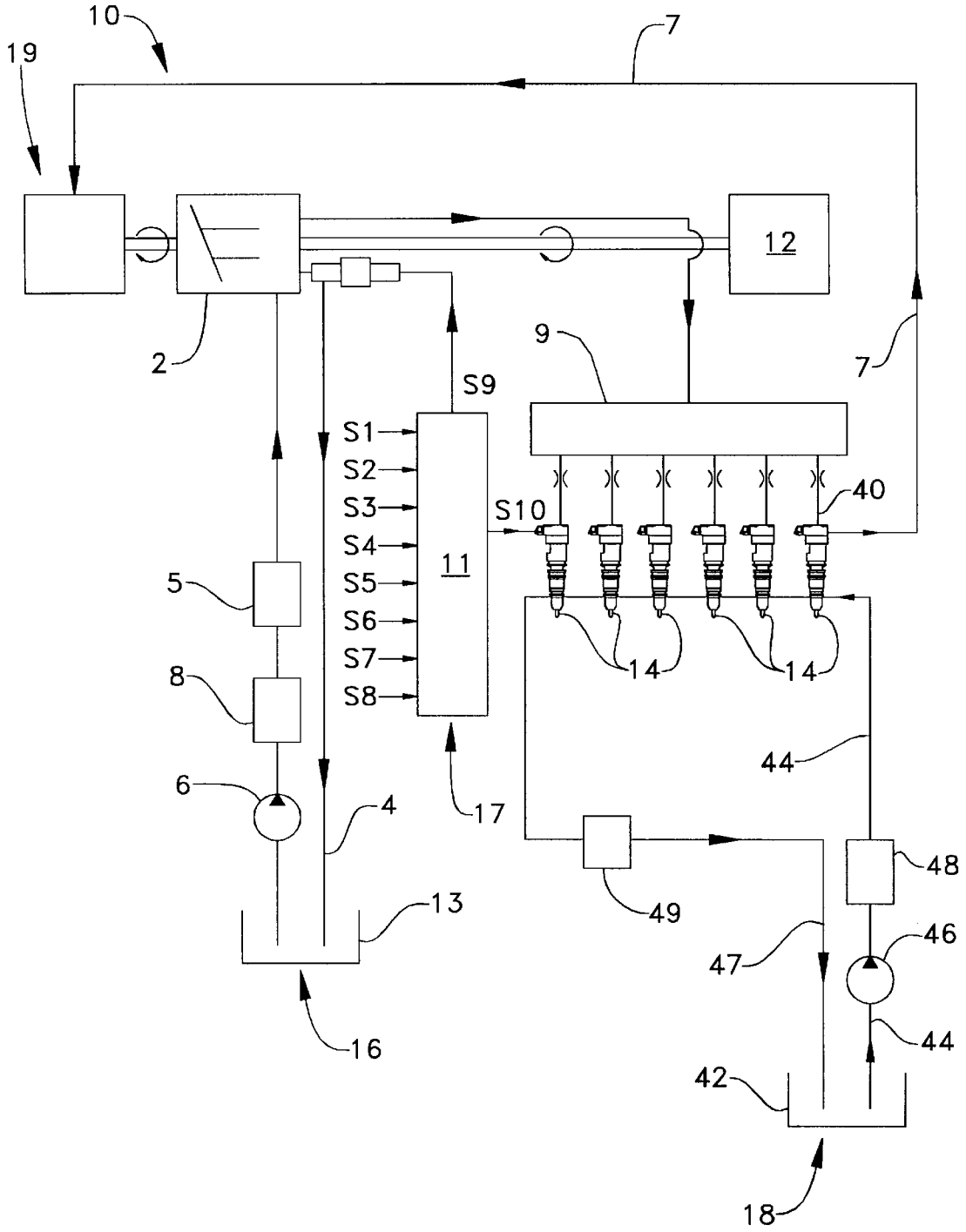
FIG. 1 is a schematic view of a hydraulically-actuated fuel injection system according to the present invention.

Referring now to FIG. 1, there is shown an embodiment of a hydraulically-actuated electronically controlled fuel injection system 10 in an example configuration as adapted for a direct injection diesel cycle internal combustion engine 12. Fuel system 10 includes one or more hydraulically-actuated electronically controlled fuel injectors 14, which are adapted to be positioned in a respective cylinder head bore of engine 12. Fuel system 10 includes an apparatus or means 16 for supplying actuating fluid to each injector 14, an apparatus or means 18 for supplying fuel to each injector, a computer for electronically controlling the fuel injection system and an apparatus or means 19 for recirculating actuation fluid and for recovering hydraulic energy from the actuation fluid leaving each of the injectors.

The actuating fluid supply means 16 preferably includes an actuating fluid sump 13, a relatively low pressure actuating fluid transfer pump 6, an actuating fluid cooler 8, one or more actuation fluid filters 5, a high pressure pump 2 for generating relatively high pressure in the actuation fluid and at least one relatively high pressure common rail 9. Common rail 9 is arranged in fluid communication with the outlet from the relatively high pressure actuation fluid pump 2. A rail branch passage 40 connects the actuation fluid inlet of each injector 14 to the high pressure common rail 9.

Actuation fluid leaving the actuation fluid drain of each injector 14 enters a recirculation line 7 that carries the same to the hydraulic energy recirculating or recovering means 19. A portion of the recirculated actuation fluid is channeled to high pressure actuation fluid pump 2 and another portion is returned to actuation fluid sump 13 via recirculation line 4. Any available engine fluid is preferably used as the actuation fluid in the present invention. However, in the preferred embodiments, the actuation fluid is engine lubricating oil and the actuation fluid sump 13 is an engine lubrication oil sump. This allows the fuel injection system to be connected as a parasitic subsystem to the engine's lubricating oil circulation system. Alternatively, the actuation fluid could be fuel provided by a fuel tank 42 or another source, such as coolant fluid, etc. The fuel supply means 18 preferably includes a fuel tank 42, a fuel supply passage 44 arranged in fluid communication between fuel tank 42 and the fuel inlet of each injector 14. Also included is a relatively low pressure fuel transfer pump 46, one or more fuel filters 48, a fuel supply regulating valve 49, and a fuel circulation and return passage 47 arranged in fluid communication between injectors 14 and fuel tank 42.

A computer 17, which includes an electronic control module 11 contains software decision logic and information defining optimum fuel system operational parameters, and also controls key components of the fuel injection system, including actuation fluid pressure and injector solenoid on-time. Electronic control module 11 receives input data signals from one or more signal indicating devices. For example, input data signals may include engine speed $S_1$, engine crank shaft position $S_2$, engine coolant temperature $S_3$, engine exhaust back pressure $S_4$, air intake manifold pressure $S_5$, hydraulic actuating fluid common rail pressure $S_6$, throttle position or desired fuel setting $S_7$, and transmission operating condition $S_8$. The output control signal $S_9$ is directed to the high pressure pump and controls the pressure of the actuation fluid in the common rail. The control signal $S_{10}$ (solenoid current) controls the injector solenoid on-time and hence the duration of each injection event. Each of the injection parameters are variably controllable independent of engine speed and load.

Figure 2:
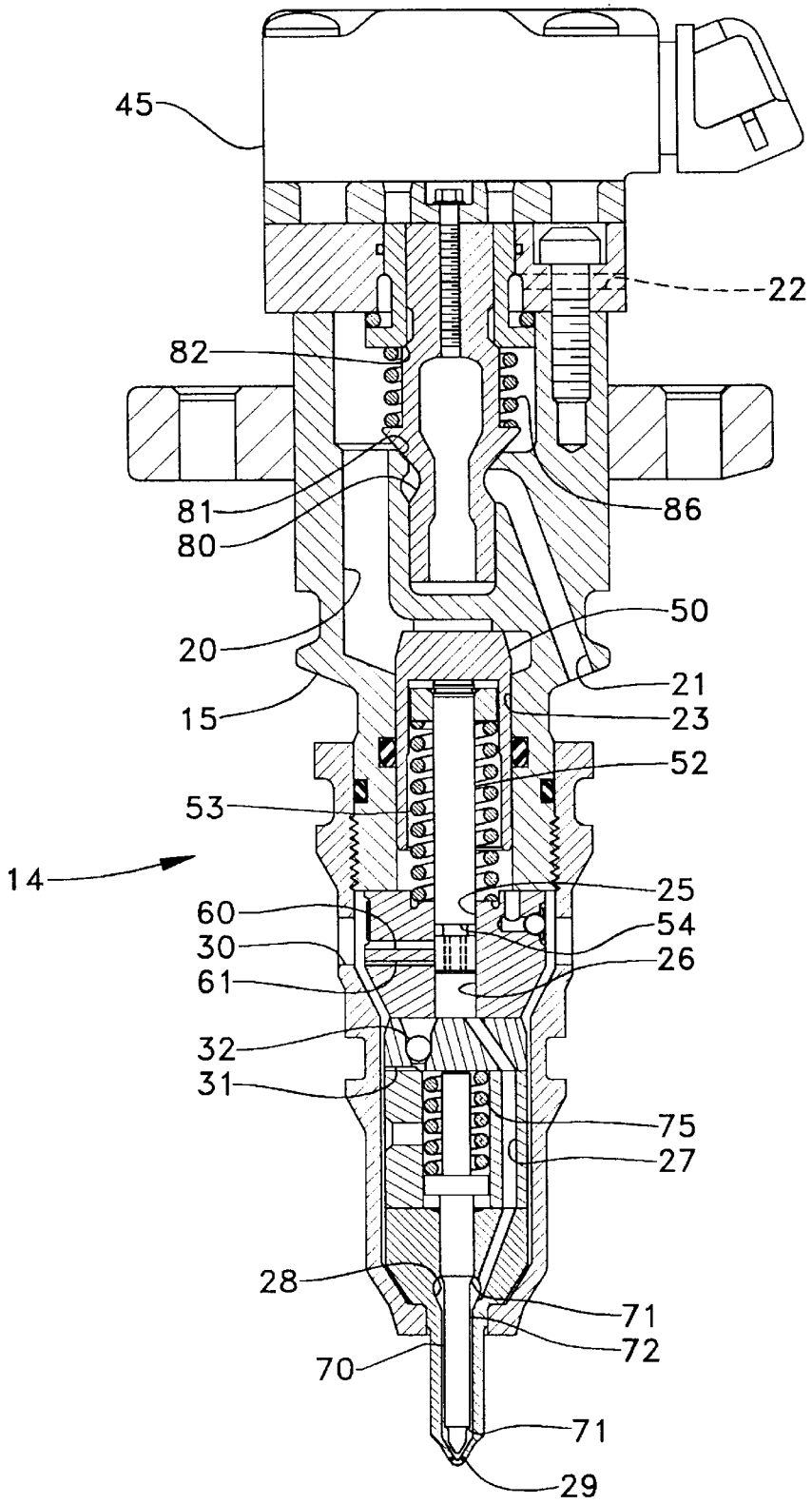
FIG. 2 is a sectioned side elevational view of a fuel injector according to the present invention.

Referring now to FIG. 2, hydraulically-actuated fuel injector 14 includes an injector body 15 made up of various components and containing various bores and passageways. In particular, injector body 15 includes an actuation fluid cavity 20 that opens to piston bore 23, high pressure actuation fluid inlet 21 past seat 81 and low pressure actuation fluid drain 22 past seat 82. When solenoid 45 is energized, poppet valve member 80 lifts against the action of spring 86 to close seat 42 and open seat 82 so that high pressure actuation fluid can flow through inlet 21 past seat 81 and into actuation fluid cavity 20. When solenoid 45 is de-energized, compression spring 86 biases poppet valve member 80 to close seat 81 and open seat 82. Thus, actuation fluid cavity 20 is normally opened to low pressure actuation fluid drain 19 when solenoid 45 is de-energized.

An intensifier piston 50 is positioned to reciprocate in piston bore 23 between a retracted position (as shown) and an advanced position. The piston moves downward when its upper hydraulic surface is exposed to high pressure actuation fluid. A return spring 53 maintains a plunger 52 in contact with the underside of intensifier piston 50, and biases both toward their retracted positions, as shown. Plunger 52 is positioned to reciprocate in a plunger bore 25 between a retracted position (as shown) and an advanced position. A portion of plunger bore 25 and plunger 52 define a fuel pressurization chamber 26.

Injector body 15 further includes a nozzle chamber 28 that opens to fuel pressurization chamber 26 via a connection passage 27, and also opens to nozzle outlet 29. A needle valve member 70 is positioned to reciprocate in the nozzle chamber 28 between an open position in which nozzle outlet 29 is open and a closed position in which nozzle outlet 29 is closed. A compression spring 75 normally biases needle valve member 70 to its closed position. When fuel pressure in nozzle chamber 28 exceeds a valve opening pressure sufficient to overcome compression spring 75, the hydraulic force acting on lifting hydraulic surfaces 71 causes needle valve member 70 to lift and open nozzle outlet 29. Needle valve member will remain in its open position for as long as the fuel pressure is sustained above a valve closing pressure, which is usually lower than the valve opening pressure. Fuel enters injector 14 at fuel inlet, return area 30 and circulates along passageway 31 past check ball 32 and into fuel pressurization chamber 26. Ball check 32 prevents the reverse flow of fuel from fuel pressurization chamber 26 back to fuel inlet 31 when plunger 52 is in its downward stroke during an injection event.

Figure 3:
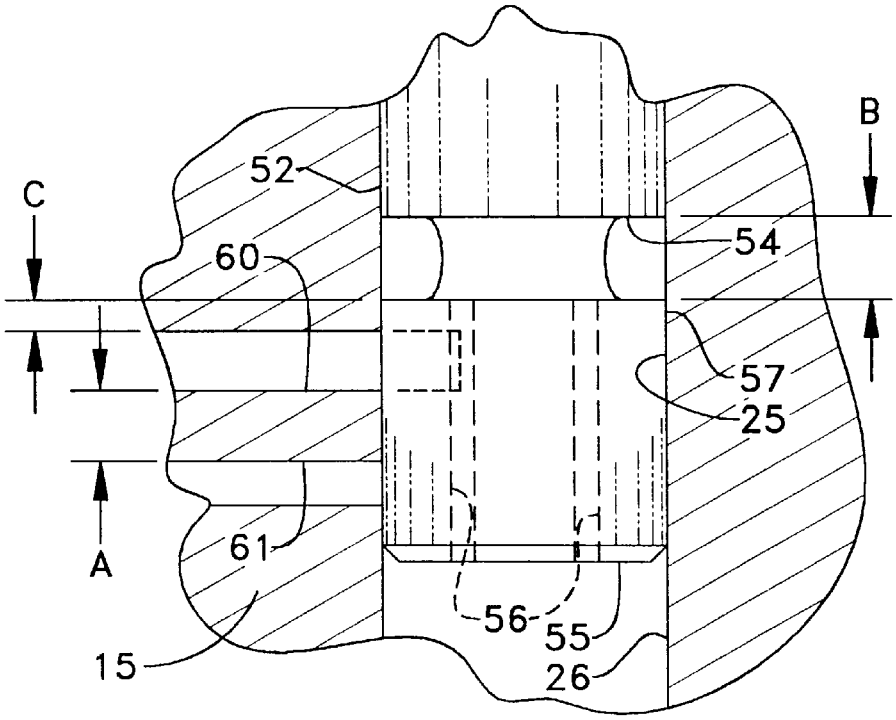
FIG. 3 is an enlarged partial sectioned side elevational view of the plunger and port area of the fuel injector shown in FIG. 2.

Referring now in addition to FIG. 3, a close-up view of the lower portion of plunger 52 is illustrated in its retracted position. Injector body 15 includes a prime spill port 60 extending between fuel inlet, return area 30 and plunger bore 25. A distance A below prime spill port 60 is an idle stability port 61, according to the present invention. Idle stability port 61 also extends between plunger bore 25 and fuel inlet/return 30. Plunger 52 includes a cylindrical outer surface 57 and an end 55. A spill passage extends between end 55 and side surface 57. In this case, this passage takes the form of an annulus 54 and several vertical spill passages 56 that open on one end into fuel pressurization chamber 26 and on the other end into annulus 54. Other plunger shapes, such as those described in previously mentioned U.S. Pat. No. 5,492,098 Hafner et al., could be utilized in conjunction with the prime port 60 of the present invention. Hafner et al. describes how the spill passage through the plunger along with the prime port inherently causes a split injection at idle and other low fuel demand conditions.

FIG. 3 shows the plunger in its retracted position such that there exists a distance C between annulus 54 and prime spill port 60. The distance C is chosen such that as plunger 52 moves downward, a small initial injection of the type shown in FIGS. 5*b*, 6*b*, 7*b* and 8*b* takes place. After plunger 52 has traveled distance C, annulus 54 opens to prime spill port 60 thus creating a fluid connection between inlet/return area 30 and fuel pressurization chamber 26.

Figure 4:
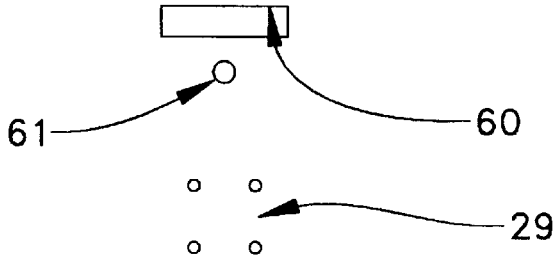
FIG. 4 is an illustration showing the relative flow area sizes of the prime spill port, the idle stability port and the nozzle outlet for the fuel injector shown in FIG. 2.

Referring now in addition to FIG. 4, the flow area of prime spill port 60 is many times the flow area of nozzle outlet 29 and idle stability port 61. The prime flow area is sufficiently large or unrestrictive that pressure in the fuel pressurization chamber drops below the valve closing pressure when the prime spill port is open and the injector is operating at an idle condition. At idle conditions, the solenoid 45 has a relatively brief on-time and the actuation fluid pressure in the common rail is relatively low. Thus, when prime spill port 60 is open, there is insufficient pressure acting on lifting hydraulic surfaces 71 of needle valve member 70 to maintain it in its open position, so it briefly closes under the action of compression spring 75. As plunger 52 continues in its downward stroke, prime spill port 60 is eventually blocked by side surface 57 of plunger 52.

In this embodiment, the distance A between prime spill port 60 and idle stability port 61 is about equal to the width B of annulus 54. This allows the injector to take full advantage of the idle stability port.

As the plunger continues its downward stroke, annulus 54 opens to idle stability port 61. Idle stability port 61 is preferably circular in shape so that its flow area can be tightly controlled. The flow area of idle stability port 61 should be about equal to or less than the flow area of nozzle outlet 29. Flow areas that are about equal in size have thus far shown the best overall performance. In any event, the combined flow area of idle stability port 61 and nozzle outlet 29 should be sufficiently small or restrictive that pressure in fuel pressurization chamber 26 is sustained above the valve closing pressure when the idle stability port is open and the injector is operating at its idle condition. Preferably, annulus 54 remains open to idle stability port 61 for the remaining portion of an idle injection event.

Since the very purpose of the idle stability port is to desensitize the fuel injection quantity to variations in rail pressure and/or poppet motion, it is important that the idle stability port not introduce new variations into the injection system. In particular, idle stability port 61 should be free of check valves or other obstructions, which could introduce variations, such as variations in spring strength etc., into the behavior of the injector. The preferably circular nature of idle stability port 61 allows its flow area to be more easily controlled during manufacturing to whatever tolerance is necessary.

Figure 9:
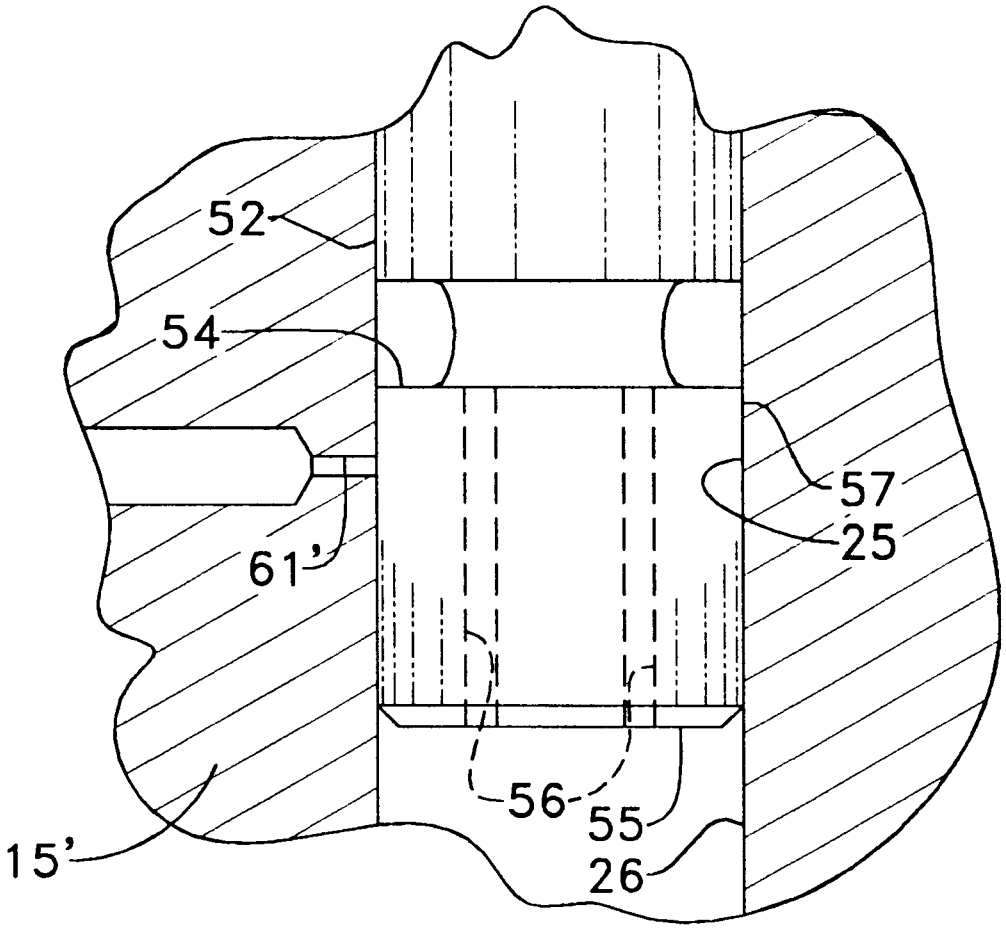
FIG. 9 is an enlarged partial sectioned side elevational view of a port and plunger area of a fuel injector according to another embodiment of the present invention.

Referring now to FIG. 9, an alternative embodiment of the present invention is illustrated, in this embodiment, an idle stability port 61' is utilized, but no prime spill port. The plunger in both cases is substantially identical. Thus, this injector would not have the ability to perform a split injection through the spillage of fuel since the flow area of idle stability port 61' would be too restrictive to allow fuel pressure underneath plunger 52 to drop below the valve closing pressure for the needle valve member 70. As in the previous embodiment, the side surface 57 of plunger 52 preferably blocks the idle stability port 61' when the plunger is retracted, as shown. In this embodiment, the idle stability port 61' opens preferably for the latter half of an idle injection, since that is generally where plunger motion fluctuations occur due to rail pressure variations and poppet motion variations. In other words, since variations in rail pressure and variations in poppet valve motion inherently lead to variations in plunger 52's motion, the idle stability port of the present invention open to the plunger bore close to the plunger so that these fluctuations are vented through the idle stability port rather than allowed to travel down to the nozzle outlet.

Industrial Applicability

Figure 5A:
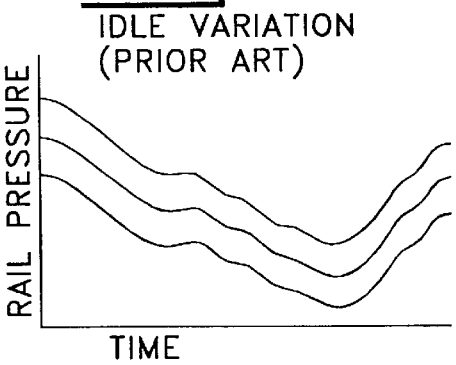
FIGS. 5*a* and 5*b* are plots of rail pressure variation and injection rate, respectively, for a prior art fuel injector.
Figure 5B:
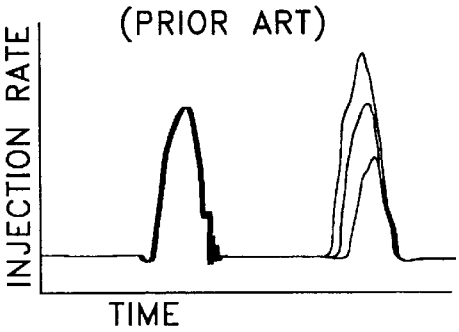

FIGS. 5*a–b* show graphs of variation in rail pressure and the consequential variations in injection mass volume, respectively, at a split idle condition for an injector of the type shown in FIG. 2, but without the idle stability port 61 of the present invention. In other words, a prior art injector. FIG. 5*b* shows that the first injection shot of the injection event is substantially identical regardless of the variations in rail pressure, yet the second shot varies significantly in its volume due to the rail pressure variation. Since this variation can amount to a substantial percentage of the total volume of fuel injected at idle conditions, an engine can exhibit some surging or other erratic behavior when the injected volume varies widely as in FIG. 5*b*.

Figure 6A:
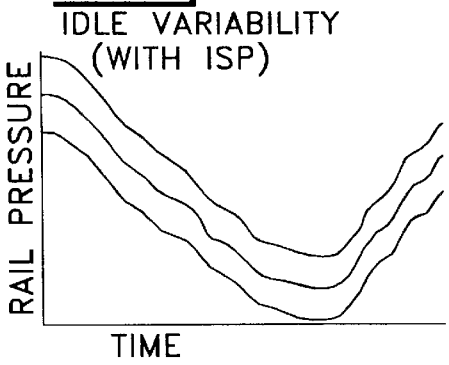
FIGS. 6*a* and 6*b* are plots of rail pressure variation and injection rate, respectively, for a fuel injector having an idle stability port according to the present invention.
Figure 6B:
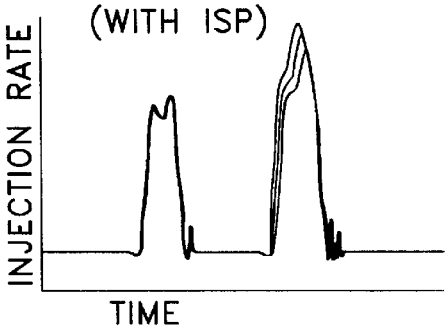

FIGS. 6*a* and 6*b* show an identical injection event, except in an injector of the type shown in FIG. 2 having an idle stability port 61 according to the present invention. FIGS. 6*b* shows that variations in the plunger's motion due to variations in the rail pressure do not result in a significant variation in injected fuel volume at split idle injection conditions. It of course being understood that the injector on-time for injector of FIG. 6*a* and 6*b* is longer than that of the injector of FIGS. 5*a* and 5*b* since an amount of fuel is being lost through the idle stability port. Since the idle stability port opens near the plunger, variations in the fuel quantity pumped by plunger 52 would be revealed if the fuel quantity lost through the idle stability port were graphed.

Figure 7A:
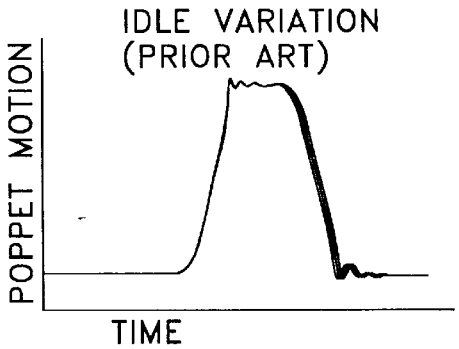
FIGS. 7*a* and 7*b* are graphs of poppet motion variation and injection rate, respectively, for an example prior art fuel injector.
Figure 8A:
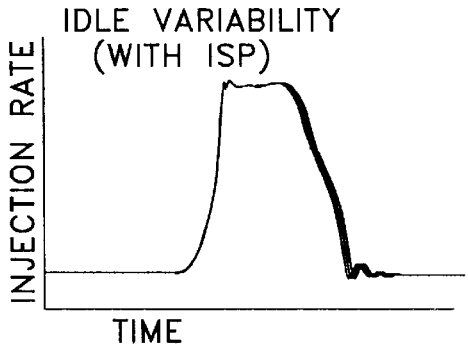
FIGS. 8*a* and 8*b* are graphs of poppet motion variation and injection rate, respectively, for a fuel injector with an idle stability port according to the present invention.
Figure 7B:
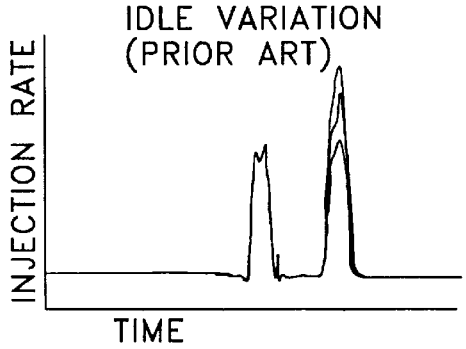
Figure 8B:
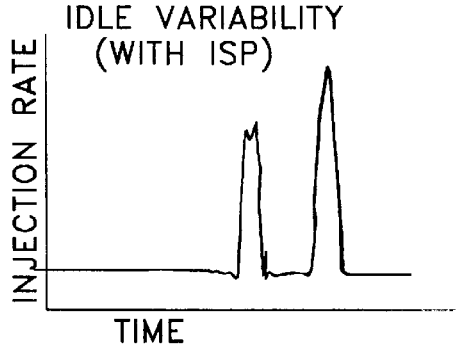

FIGS. 7*a* and 7*b* show an example idle split injection event for a prior art fuel injector of the type shown in FIG. 2, but without an idle stability port, over an expected range of variations in poppet valve motion. FIG. 7*b* shows that the injection quantity of the second shot in the split injection at idle conditions varies significantly. Again, this variation in total fuel quantity injected at idle conditions can result in undesirable erratic and unsteady engine performance. By simply including an idle stability port in an identical injector as that which produced the curves of FIGS. 7*a* and 7*b*, the variation in injection rate quantity is virtually eliminated (see FIG. 8*b*). Thus, by an appropriate sizing and positioning of an idle stability port, the injectors injected mass flow quantity can be desensitized to variations in plunger motion. This desensitization occurs despite the source of the variation as being from variations in rail pressure and/or changes in poppet valve motion.

Those skilled in the art will appreciate that the idle stability port must be sized to have a sufficiently small flow area that fuel pressure remains above the valve closing pressure of the needle valve member 70. Otherwise, the function of the idle stability port would be destroyed since the needle valve member would be closed when the idle stability port was open. Also, the idle stability port must be sufficiently large that it has some effect on the behavior of the injector at idle conditions. Preferably, the flow area of the idle stability port is about equal to that of the nozzle outlet. It is important to note that at idle conditions, the plunger moves a relatively short distance in its downward stroke, but at rated conditions the plunger moves a relatively large distance in order to inject a volume of fuel that could be ten or more times larger than the injected quantity at idle conditions.

If injection mass flow were graphed for the injector of the present invention at rated conditions, the graph would be virtually identical to that illustrated in prior U.S. Pat. No. 5,492,098 to Hafner et al. In other words, since the flow area of the idle stability port is so small and because it is open for only a relatively brief period during the downward stroke of the plunger at rated conditions, the idle stability port has very little effect on injection quantity or profile at rated conditions. Thus, the idle stability port of the present invention only comes into play at idle or other low fuel demand situations because that is when the injector is most sensitive to variations in rail pressure and/or poppet valve motion. Those skilled in the art will appreciate that the idle stability port of the present invention could be made to be open almost all the time at idle and rated conditions, but this would only result in a waste of energy by having the injector unnecessarily pump fuel into the recirculation line without obtaining any benefit. In order to minimize the waste of energy from pumping fuel through the idle stability port, it should preferably be positioned to open only during the latter half of an injection event at idle conditions, since engineers have observed that being the area where the injector is most sensitive to variations in plunger motion, from whatever source.

We claim:

1. A Hydraulically actuated fuel injector comprising:

an injector body having a nozzle chamber that opens to a nozzle outlet and a plunger bore, and further having an idle stability port that opens to said plunger bore;

hydraulic means for pressurizing fuel in said nozzle chamber, which includes a plunger mounted to reciprocate in said plunger bore between a retracted position and an advanced position;

a portion of said plunger bore and said plunger defining a fuel pressurization chamber;

a needle valve member mounted to reciprocate in said nozzle chamber between an open position in which said nozzle outlet is open and a closed position in which said nozzle outlet is closed;

said plunger moving from said retracted position toward said advanced position a relatively short distance when said injector is operating at an idle condition;

said idle stability port having a port flow area sufficiently restrictive that pressure in said nozzle chamber is sustained above a valve closing pressure when said idle stability port is open and said injector is operating at said idle condition; and a portion of said plunger blocking said idle stability port when said plunger is in said retracted position.

2. The hydraulically actuated fuel injector of claim 1 wherein said idle stability port is free of obstructions.

3. The hydraulically actuated fuel injector of claim 2 wherein said plunger moves from said retracted position toward said advanced position a relatively large distance when said injector is operating at a rated condition; and a portion of said plunger blocks said idle stability port over most of said relatively large distance.

4. The hydraulically actuated fuel injector of claim 1 wherein said nozzle outlet has a nozzle flow area about equal to or larger than said port flow area.

5. The hydraulically actuated fuel injector of claim 4 wherein said nozzle flow area is about equal to said port flow area.

6. The hydraulically actuated fuel injector of claim 1 wherein said idle spill port includes a circular bore opening into said plunger bore.

7. The hydraulically actuated fuel injector of claim 1 wherein said plunger has an end and a cylindrical surface, and includes a spill passage extending between said end and said cylindrical surface.

8. The hydraulically actuated fuel injector of claim 1 wherein said injector body further includes a prime spill port with a prime flow area opening to said plunger bore; and said prime flow area is sufficiently unrestrictive that pressure in said nozzle chamber drops below a valve closing pressure when said prime spill port is open and said injector is operating at said idle condition.

9. The hydraulically actuated fuel injector of claim 8 wherein said prime spill port opens to said plunger bore above said idle stability port.

10. The hydraulically actuated fuel injector of claim 9 wherein a portion of said plunger blocks said prime spill port when said idle stability port is open to said fuel pressurization chamber.

11. The hydraulically actuated fuel injector of claim 10 wherein said plunger includes an annulus with a width; and said prime spill port is separated from said idle stability port a distance about equal to said width.

12. A Hydraulically actuated fuel injector comprising:

an injector body having a nozzle chamber that opens to a nozzle outlet and a plunger bore, and further having a prime spill port and an idle stability port that open to said plunger bore;

hydraulic means for pressurizing fuel in said nozzle chamber, which includes a plunger mounted to reciprocate in said plunger bore between a retracted position and an advanced position;

a portion of said plunger bore and said plunger defining a fuel pressurization chamber;

a needle valve member mounted to reciprocate in said nozzle chamber between an open position in which said nozzle outlet is open and a closed position in which said nozzle outlet is closed;

a portion of said plunger blocking said prime spill port when said plunger is in said retracted position;

a different portion of said plunger blocking said idle stability port when said plunger is in said retracted position;

said prime spill port opening to said fuel pressurization chamber over part of said plunger's stroke between said retracted position and said advanced position; and said idle stability port opening to said fuel pressurization chamber over a different part of said plunger's stroke between said retracted position and said advance position.

13. The hydraulically actuated fuel injector of claim 12 wherein said plunger moves from said retracted position toward said advanced position a relatively short distance when said injector is operating at an idle condition;

said prime spill port has a prime flow area; and said prime flow area is sufficiently unrestrictive that pressure in said nozzle chamber drops below a valve closing pressure when said prime spill port is open and said injector is operating at said idle condition.

14. The hydraulically actuated fuel injector of claim 13 wherein said prime spill port opens to said plunger bore above said idle stability port.

15. The hydraulically actuated fuel injector of claim 14 wherein said plunger includes an annulus with a width; and said prime spill port is separated from said idle stability port a distance about equal to said width.

16. The hydraulically actuated fuel injector of claim 12 wherein said nozzle outlet has a nozzle flow area about equal to or larger than said port flow area.

17. The hydraulically actuated fuel injector of claim 16 wherein said nozzle flow area is about equal to said port flow area.

18. The hydraulically actuated fuel injector of claim 12 wherein said idle spill port includes a circular bore opening into said plunger bore.

19. The hydraulically actuated fuel injector of claim 12 wherein said plunger has an end and a cylindrical surface, and includes a spill passage extending between said end and said cylindrical surface.

20. A Hydraulically actuated fuel injector comprising:

an injector body having a nozzle chamber that opens to a nozzle outlet and a plunger bore, and further having an idle stability port that opens to said plunger bore;

hydraulic means for pressurizing fuel in said nozzle chamber, which includes a plunger mounted to reciprocate in said plunger bore between a retracted position and an advanced position;

a portion of said plunger bore and said plunger defining a fuel pressurization chamber;

a needle valve member mounted to reciprocate in said nozzle chamber between an open position in which said nozzle outlet is open and a closed position in which said nozzle outlet is closed, and having a lifting hydraulic surface exposed to pressure in said nozzle chamber;

means, including said idle stability port, for desensitizing fuel injection quantity from variations in movement of said plunger when said fuel injector is operating at an idle condition.

* * * * *